US008025557B2

(12) United States Patent
Andrichik et al.

(10) Patent No.: US 8,025,557 B2
(45) Date of Patent: Sep. 27, 2011

(54) SANDING CLAY

(75) Inventors: William R. Andrichik, Dallas, TX (US); Mohsen S. Marzouk, Flower Mound, TX (US)

(73) Assignee: Illinois Tool Works Inc., Glenview, IL (US)

( * ) Notice: Subject to any disclaimer, the term of this patent is extended or adjusted under 35 U.S.C. 154(b) by 244 days.

(21) Appl. No.: 12/394,782

(22) Filed: Feb. 27, 2009

(65) Prior Publication Data

US 2010/0221981 A1 Sep. 2, 2010

(51) Int. Cl.
*B24B 1/00* (2006.01)

(52) U.S. Cl. ..... 451/59; 451/526; 51/299; 51/308

(58) Field of Classification Search ..... 451/59, 451/526; 51/299, 308
See application file for complete search history.

(56) References Cited

U.S. PATENT DOCUMENTS

| | | | | |
|---|---|---|---|---|
| 1,669,596 | A | 5/1928 | Browne | |
| 1,990,737 | A * | 2/1935 | Kuzmick et al. | 51/298 |
| 2,355,667 | A * | 8/1944 | Ball et al. | 451/534 |
| 2,885,276 | A * | 5/1959 | Upton, Jr. | 51/298 |
| 3,089,764 | A | 5/1963 | Smith-Gorman | |
| 3,631,638 | A * | 1/1972 | Yoshikawa et al. | 51/295 |
| 3,773,480 | A * | 11/1973 | Hall et al. | 51/295 |
| 3,909,217 | A | 9/1975 | Perry | |
| 4,367,253 | A * | 1/1983 | Hayes | 428/75 |
| 4,421,526 | A | 12/1983 | Strickman et al. | |
| 4,512,859 | A * | 4/1985 | Inoue | 451/36 |
| 4,652,275 | A | 3/1987 | Bloecher et al. | |
| 5,125,191 | A | 6/1992 | Rhoades | |
| 5,203,123 | A * | 4/1993 | Travis | 451/490 |
| 5,203,883 | A * | 4/1993 | Perry | 51/293 |
| 5,476,416 | A * | 12/1995 | Kodate | 451/526 |
| 5,669,942 | A | 9/1997 | McCullough | |
| 5,716,259 | A * | 2/1998 | Miller | 451/59 |
| 5,727,993 | A * | 3/1998 | Kodate | 451/59 |
| 5,928,064 | A * | 7/1999 | Miller | 451/59 |
| 6,003,505 | A | 12/1999 | Dalton et al. | |
| 6,083,290 | A | 7/2000 | Ikeda et al. | |
| 6,235,070 | B1 | 5/2001 | Beermann | |
| 2004/0035058 | A1 | 2/2004 | Tominaga et al. | |
| 2007/0066186 | A1 | 3/2007 | Annen et al. | |
| 2007/0293130 | A1 | 12/2007 | Miekka et al. | |

FOREIGN PATENT DOCUMENTS

| | | |
|---|---|---|
| DE | 19539218 A1 | 5/1996 |
| GB | 975002 | 11/1964 |
| JP | 5884880 | 5/1983 |
| JP | 235977 | 2/1990 |
| RU | 2293097 C1 | 10/2007 |
| WO | 9830362 A1 | 7/1998 |

* cited by examiner

*Primary Examiner* — Maurina Rachuba
(74) *Attorney, Agent, or Firm* — Setter Roche LLP

(57) ABSTRACT

A flexible sanding composite in accordance with the principles of the invention includes about 10% to about 70% by weight liquid component, such as polybutene and/or oleic acid; about 30% to about 80% by weight abrasive material including calcium carbonate and aluminum oxide; and about 0% to about 5% by weight synthetic rubber. The invention also includes a method of removing dirt or contamination from a surface, or flattening surface irregularities, which includes rubbing the flexible sanding composite against the surface repeatedly until the dirt or contamination is diminished.

21 Claims, 1 Drawing Sheet

SANDING CLAY

FIELD OF THE INVENTION

This invention relates to a flexible sanding composite for use in removing dirt and contamination from a surface, as well as smoothing or flattening hard surface irregularities as found on such surfaces as painted automotive finishes, granite tops, marine gel coats, or any other coated, painted, or unpainted, hard or composite surface.

BACKGROUND OF THE INVENTION

For centuries, sandpaper and abrasive-impregnated emery cloth papers have been the tools of choice for removing small layers of material, such as dirt and contamination, and leveling irregularities from surfaces. Sandpaper can also make the surface smoother or rougher. The flexibility of a paper backing allows sandpaper to follow irregular or rounded contours of virtually any surface shape, with limitations. Numerous motor-driven devices have been developed to facilitate the handling of sandpaper, such as belt sanders, detail sanders, disc sanders, palm sanders, and orbit sanders.

Despite the development of these sanding devices, sandpaper is still commonly used by hand for both small touch-up areas as well as large areas. Sanding a surface by hand, as opposed to using a motor-driven sanding device, provides the user with complete control over the amount of pressure applied and the exact location to which the abrasive material is applied.

A variety of sanding blocks provide a handle in order to more easily grip the sandpaper. The most basic type of sanding block is essentially a block of wood or other hard material around which sandpaper can be wrapped, thus providing a handle for gripping the sandpaper while sanding a surface. Once the sandpaper has become worn in at least one area, the position of the sandpaper can be adjusted on the block in order to utilize other lesser-used areas of the sandpaper. Such sanding blocks are often more comfortable to use than sandpaper alone, but these blocks typically lack the flexibility needed to follow irregular, contoured, or narrow surfaces, which results in uneven pressure being applied to such surfaces and, consequently, uneven sanding.

Some sanding blocks are integral with the sandpaper, such as sponge-backed sanding blocks. These sponge-backed sanding blocks provide a handle and the sponge backing maintains sufficient flexibility to allow the sandpaper to follow the contours of the surface being sanded. One drawback of these sponge-backed sanding blocks is that the surfaces of abrasive material are prone to uneven wear. That is, the abrasive material may wear off on certain areas of the sanding block while other less-frequently-used areas of the sanding block remain intact. However, the less-frequently-used areas may experience less usage because their locations are impractical or uncomfortable for the user. Thus, the sponge-backed sanding block is typically discarded after only a fraction of the abrasive material has worn off.

There is a need or desire for an aggressive sanding device for use in removing dirt and contamination from a surface, particularly from a painted metal surface, and to smooth and/or flatten uneven, irregular surfaces. There is a further need or desire for a sanding device capable of applying even pressure along the surface being sanded. There is yet another need or desire for a sanding device that can be used repeatedly without uneven wear.

SUMMARY OF THE INVENTION

Sanding clay in accordance with the principles of the invention may be in the form of a flexible sanding composite including about 10% to about 70% by weight liquid component, about 30% to about 80% by weight abrasive material, and about 0% to about 5% by weight synthetic rubber.

The liquid component may include polybutene and/or oleic acid, for example. In certain embodiments, the liquid component includes 1% to 100% by weight polybutene, or 1% to 20% by weight polybutene. Additionally or alternatively, the liquid component may include 1% to 100% by weight oleic acid, or 1% to 20% by weight oleic acid.

The abrasive material may include calcium carbonate and/or aluminum oxide, for example. In certain embodiments, the abrasive material includes 1% to 100% by weight calcium carbonate, or 30% to 70% by weight calcium carbonate. Additionally or alternatively, the abrasive material may include 1% to 100% by weight aluminum oxide, or 0% to 20% by weight aluminum oxide. The abrasive material suitably has an average particle size between about 1 and about 50 micrometers (μm).

The synthetic rubber may include butyl rubber, cross-linked butyl rubber, or combinations thereof. The flexible sanding composite may further include less than 1% by weight color pigment.

A method of removing dirt or contamination from a surface, in accordance with the principles of the invention, includes rubbing the flexible sanding composite against the surface repeatedly until the dirt or contamination is diminished and the rubbed surface is level and flat in relation to the surrounding un-touched surfaces. The method may further include scratching the surface with the flexible sanding composite. In certain embodiments, the method includes applying a lubricant to the surface prior to rubbing the surface with the flexible sanding composite. The surface may be a surface on a vehicle or a surface on industrial machinery, for example.

This invention will become more fully understood from the following detailed description, taken in conjunction with the accompanying drawings described herein below, and wherein like reference numerals refer to like parts.

DESCRIPTION OF PREFERRED EMBODIMENTS

Figure 1:
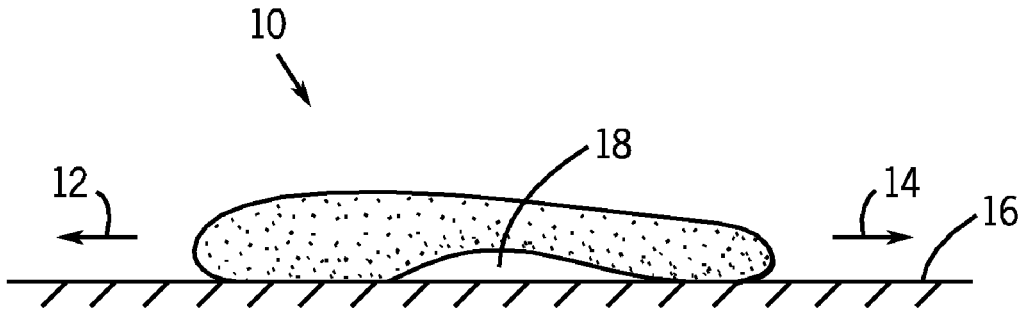
FIG. 1 illustrates a flexible sanding composite applied to a surface.

Sanding clay 10 formed of a flexible sanding composite is illustrated in FIG. 1. As indicated by the arrows 12 and 14, the sanding clay 10 can be rubbed against a surface 16 repeatedly to remove dirt or contamination 18 from the surface 16, or to flatten surface irregularities.

The highly aggressive sanding clay 10 can be used on a variety of surfaces, such as on clear-coated paint surfaces or on metal. For example, the sanding clay 10 can be used in body shop preparation of vehicles, such as for wet-sanding. The sanding clay 10 can also be used in heavy-duty industrial cleaning applications. More particularly, the sanding clay 10 is capable of pulling metal filings off of industrial machinery as well as pulling impurities off of industrial machinery, such as food preparation machinery, thus resulting in an exceptionally clean surface. The sanding clay 10 can be further used to polish metal. However, in contrast with "polishing clay," the sanding clay 10 described herein is highly aggressive/abrasive and is consequently capable of scratching the surface to which the clay is applied. Thus, when polishing or cleaning surfaces with the sanding clay 10, it is expected that the surface will be scratched. In applications using the sanding clay 10, scratch patterns are often inevitable, but because the scratching is expected, the marring is typically inconsequential.

The flexible sanding composite of which the sanding clay 10 is formed includes about 10% to about 70% by weight liquid component. In certain embodiments, the sanding clay 10 may include 12% to about 50% by weight liquid component, or 15% to about 25% by weight liquid component. The liquid component may include 1% to 100% byweightpolybutene, or 1% to 20% by weight polybutene, or 8% to 16% by weight polybutene. Additionally or alternatively, the liquid component may include 1% to 100% by weight oleic acid, or 1% to 20% by weight oleic acid, or 5% to 14% by weight oleic acid. In certain embodiments, the liquid component may include both polybutene and oleic acid. The liquid component may include either high molecular weight polybutene, or low molecular weight polybutene, or a mixture of high and low molecular weight polybutene, depending on the intended use of the sanding clay 10. The different molecular weights of polybutene provide different consistencies. For example, a high molecular weight polybutene having a molecular weight of 18,000, for example, provides a consistency comparable to hard, flexible rubber. In contrast, a low molecular weight polybutene having a molecular weight of 100, for example, provides a consistency comparable to soft, flexible rubber. Thus, by combining these two different types of polybutene, a consistency anywhere between these two types can be achieved. One example of a commercially-available high molecular weight polybutene is Indopol® H-18,000, available from INEOS of League City, Tex. One example of a commercially-available low molecular weight polybutene is Indopol® H-100, also available from INEOS. An example of a commercially-available oleic acid is Emersol® 213, available from Cognis Oleochemicals of Cincinnati, Ohio.

The flexible sanding composite also includes about 30% to about 80% by weight abrasive material. In certain embodiments, the flexible sanding composite may include 50% to about 80% by weight abrasive material, or 70% to about 80% by weight abrasive material. The abrasive material may include 1% to 100% by weight calcium carbonate, or 75% to 95% by weight calcium carbonate. Additionally or alternatively, the abrasive material may include 1% to 100% by weight aluminum oxide, or 0% to 20% by weight aluminum oxide. In certain embodiments, the abrasive material may include both calcium carbonate and aluminum oxide. The particle sizes of the abrasive material may vary in accordance with a desired level of coarseness. An average particle size is determined by measuring the particles across their greatest diameter for both regular-shaped particles and irregular-shaped particles. In general, the abrasive material may have an average particle size between about 1 and about 50 micrometers (μm). For instance, for sanding clay having a level of coarseness approximately equal to sandpaper grit of about 1600 (fine), the average particle size of the abrasive material may be between about 1 and about 10 μm, whereas sanding clay having a level of coarseness approximately equal to sandpaper grit of about 600 (coarse), the average particle size of the abrasive material may be between about 10 and about 20 μm. An example of a commercially-available calcium carbonate is Gamaco®, available from Imerys Performance Minerals of Roswell, Ga. An example of a commercially-available aluminum oxide is polishing grade alumina, available from Alcoa of Pittsburgh, Pa.

The flexible sanding composite also includes about 0% to about 5% by weight synthetic rubber. The synthetic rubber may include butyl rubber, cross-linked butyl rubber, or combinations of these materials. The synthetic rubber is typically added to the liquid component and the abrasive material in the form of pellets. When the pellets are heated, the pellets melt and encase the other materials within the flexible sanding composite, particularly the abrasive material. The flexible sanding composite can be formed through an extrusion process, resulting in a relatively thin shape, if so desired. The flexible sanding composite may also include about 1% by weight or less of a color pigment in order to provide the sanding clay with a distinctive appearance, or to create a more attractive appearance.

The flexible sanding composite may have the consistency of hydrated clay, but the composite does not necessarily include any clay materials, such as bentonite or kaolinite. This consistency allows the user to mold and shape the sanding clay 10, as well as to knead the composite to bring up a fresh sanding (abrasive) surface, which provides extended use of the sanding clay 10 without uneven wear. Additionally, this consistency allows the user to shape the sanding clay 10 into virtually any shape, including flat, to accommodate the user's preference, thus allowing quicker completion of a project.

As described above, the sanding clay 10 can be used to remove dirt or contamination 18 from a surface 16, or to flatten surface irregularities, by rubbing the sanding clay 10 against the surface 16 repeatedly until the dirt or contamination 18 is diminished or gone, or until the surface irregularities are flattened. As used herein, the terms "contamination" and "irregularities" are used interchangeably to refer to essentially any unwanted substance that is present on a surface. For example, the contamination may be in the form of dirt, markings, rust, paint or other coating layers, adhesive substances, or the like. Similarly, the irregularities may be in the form of dirt, markings, rust, paint or other coating layers, adhesive substances, or the like that protrude above a portion of the surface 16.

FIG. 1 illustrates the flexible sanding composite in the form of sanding clay 10 applied to a surface 16. Arrows 12 and 14 indicate the repetitive movement of the sanding clay 10 against the surface 16. Due to the high concentration of abrasive material, the highly aggressive sanding clay 10 tends to scratch the surface 16. Despite the scratches, the sanding clay 10 effectively removes contamination 18 from the surface 16 and/or levels surface irregularities. As mentioned above, the surface 16 may be a surface on a vehicle, or a surface on industrial machinery, or virtually any other hard surface such as granite tops, marine gel coats, or other coated, painted, or unpainted hard or composite surfaces.

Figure 2:
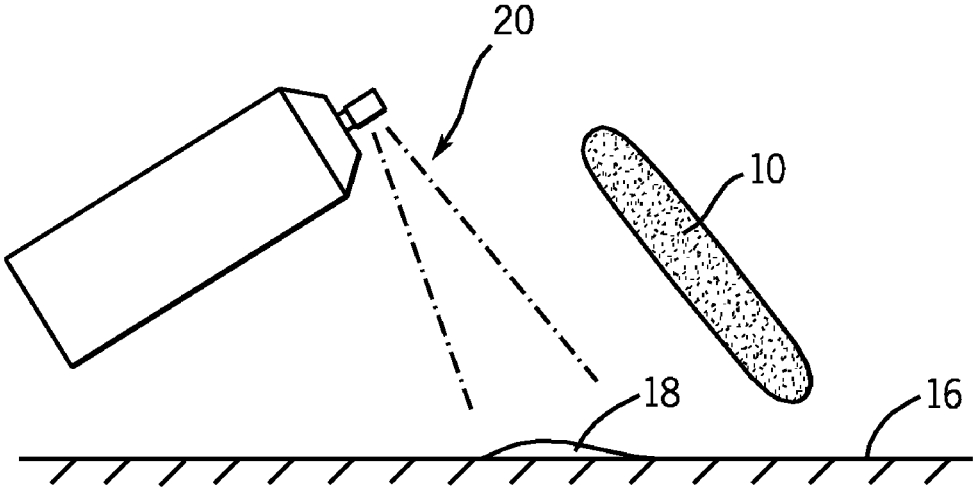
FIG. 2 illustrates a lubricant used on a surface in conjunction with a flexible sanding composite.

The sanding clay 10 can also be used to wet-sand a vehicle or other surface 16, as illustrated in FIG. 2. Wet-sanding can be carried out by applying a lubricant 20, namely an aqueous-based lubricant, to the surface 16 prior to rubbing the surface 16 with the sanding clay 10. One example of a commercially-available lubricant is Clay Lube®, available from ITW/Auto Wax of Dallas, Tex.

The following examples illustrate various embodiments of the sanding clay 10.

EXAMPLE 1

In this example, the sanding clay was formed of 20.83 wt % liquid component, 76.40 wt % abrasive material, 1.13 wt % synthetic rubber, and 0.48 wt % color pigment. A more specific breakdown of the sanding clay composition is provided in Table 1:

TABLE 1

Composition of Clay in Example 1

| Commercial Name | Manufacturer | Category | Description | Wt % |
|---|---|---|---|---|
| Emersol ® 213 | Cognis | Liquid | Oleic Acid | 10.86 |
| Indopol ® H-100 | INEOS | Liquid | Polybutene | 5.44 |
| Indopol ® H-18,000 | INEOS | Liquid | Polybutene | 4.53 |
| Gamaco ® | Imerys | Abrasive | Calcium Carbonate | 10.69 |
| Piqua Limestone 70 | Piqua Materials | Abrasive | Calcium Carbonate | 21.91 |
| Vantalc ® F-2504 | R. T. Vanderbilt Co. | Abrasive | Calcium Carbonate | 9.79 |
| Vicron ® 41-8 | Minerals Tech. | Abrasive | Calcium Carbonate | 32.14 |
| P815/816 | Sawamura | Abrasive | Aluminum Oxide | 1.87 |
| BHA | Penta Manufacturing | Abrasive | Antioxidant | 0.04 |
| Aluminum Stearate | Ferro | Abrasive | Mold Release | 1.12 |
| Kalar ® 5246 | Royal Elastomers | Rubber | Rubber | 1.13 |
| $TiO_2$ | DuPont | Pigment | Pigment | 0.48 |
| Graphthol Blue BBL | Pylam Products | Pigment | Pigment | 0.004 |

The abrasive material had an average particle size of about 15-50 micrometers. As a result of the concentration of abrasive material and average particle size, this sanding clay had a coarseness of about 600-800 grit.

EXAMPLE 2

In this example, the sanding clay was formed of 22.07 wt % liquid component, 71.89 wt % abrasive material, 3.85 wt % synthetic rubber, and 0.64 wt % color pigment. A more specific breakdown of the sanding clay composition is provided in Table 2:

TABLE 2

Composition of Clay in Example 2

| Commercial Name | Manufacturer | Category | Description | Wt % |
|---|---|---|---|---|
| Emersol ® 213 | Cognis | Liquid | Oleic Acid | 8.25 |
| Indopol ® H-100 | INEOS | Liquid | Polybutene | 1.50 |
| Indopol ® H-18,000 | INEOS | Liquid | Polybutene | 12.32 |
| Gamaco ® | Imerys | Abrasive | Calcium Carbonate | 23.00 |
| Piqua Limestone 70 | Piqua Materials | Abrasive | Calcium Carbonate | 17.60 |
| Vantalc ® F-2504 | R. T. Vanderbilt Co. | Abrasive | Calcium Carbonate | 21.03 |
| Vicron ® 41-8 | Minerals Tech. | Abrasive | Calcium Carbonate | 7.69 |
| P815/816 | Sawamura | Abrasive | Aluminum Oxide | 2.57 |
| BHA | Penta Manufacturing | Abrasive | Antioxidant | 0.05 |
| Aluminum Stearate | Ferro | Abrasive | Mold Release | 1.50 |
| Kalar ® 5246 | Royal Elastomers | Rubber | Rubber | 3.85 |
| $TiO_2$ | DuPont | Pigment | Pigment | 0.60 |
| Graphthol Blue BBL | Pylam Products | Pigment | Pigment | 0.04 |

The abrasive material had an average particle size of about 9-40 micrometers. As a result of the concentration of abrasive material and average particle size, this sanding clay had a coarseness of about 1,000-1,200 grit.

EXAMPLE 3

In this example, the sanding clay was formed of 20.83 wt % liquid component, 76.40 wt % abrasive material, 1.13 wt % synthetic rubber, and 0.48 wt % color pigment. A more specific breakdown of the sanding clay composition is provided in Table 3:

TABLE 3

Composition of Clay in Example 3

| Commercial Name | Manufacturer | Category | Description | Wt % |
|---|---|---|---|---|
| Emersol ® 213 | Cognis | Liquid | Oleic Acid | 10.86 |
| Indopol ® H-100 | INEOS | Liquid | Polybutene | 5.44 |
| Indopol ® H-18,000 | INEOS | Liquid | Polybutene | 4.53 |

TABLE 3-continued

Composition of Clay in Example 3

| Commercial Name | Manufacturer | Category | Description | Wt % |
|---|---|---|---|---|
| Gamaco ® | Imerys | Abrasive | Calcium Carbonate | 0.00 |
| Piqua Limestone 70 | Piqua Materials | Abrasive | Calcium Carbonate | 21.91 |
| Vantalc ® F-2504 | R. T. Vanderbilt Co. | Abrasive | Calcium Carbonate | 7.35 |
| Vicron ® 41-8 | Minerals Tech. | Abrasive | Calcium Carbonate | 32.14 |
| P815/816 | Sawamura | Abrasive | Aluminum Oxide | 15.00 |
| BHA | Penta Manufacturing | Abrasive | Antioxidant | 0.04 |
| Aluminum Stearate | Ferro | Abrasive | Mold Release | 1.12 |
| Kalar ® 5246 | Royal Elastomers | Rubber | Rubber | 1.13 |
| $TiO_2$ | DuPont | Pigment | Pigment | 0.48 |
| Graphthol Blue BBL | Pylam Products | Pigment | Pigment | 0.00 |

The abrasive material had an average particle size of about 1-20 micrometers. This sanding clay was primarily the same as the sanding clay in Example 1, but with a different blend of abrasive materials. In Example 1, the abrasive material included 96 wt % calcium carbonate and 2 wt % aluminum oxide, whereas in Example 3 the abrasive material included merely 79 wt % calcium carbonate and 19 wt % aluminum oxide. As a result of the concentration and composition of the abrasive material, as well as average particle size, this sanding clay had a coarseness of about 1,600-2,000 grit.

It should be understood that various changes and modifications to the preferred embodiments described herein would be apparent to those skilled in the art. Such changes and modifications can be made without departing from the spirit and scope of the present invention and without demising its attendant advantages. It is therefore intended that such changes and modifications be covered by the appended claims

What is claimed is:

1. A flexible sanding composite comprising:
about 10% to about 70% by weight liquid component;
about 30% to about 80% by weight abrasive material; and
up to about 5% by weight synthetic rubber, wherein the synthetic rubber comprises at least one of the group consisting of butyl rubber, cross-linked butyl rubber, and combinations thereof.

2. The flexible sanding composite of claim 1, wherein the liquid component comprises 1% to 100% by weight polybutene.

3. The flexible sanding composite of claim 1, wherein the liquid component comprises 1% to 20% by weight polybutene.

4. The flexible sanding composite of claim 1, wherein the liquid component comprises 1% to 100% by weight oleic acid.

5. The flexible sanding composite of claim 1, wherein the liquid component comprises 1% to 20% by weight oleic acid.

6. The flexible sanding composite of claim 1, wherein the liquid component comprises polybutene and oleic acid.

7. The flexible sanding composite of claim 1, wherein the abrasive material comprises 1% to 100% by weight calcium carbonate.

8. The flexible sanding composite of claim 1, wherein the abrasive material comprises 30% to 70% by weight calcium carbonate.

9. The flexible sanding composite of claim 1, wherein the abrasive material comprises 1% to 100% by weight aluminum oxide.

10. The flexible sanding composite of claim 1, wherein the abrasive material comprises 0% to 20% by weight aluminum oxide.

11. The flexible sanding composite of claim 1, wherein the abrasive material comprises calcium carbonate and aluminum oxide.

12. The flexible sanding composite of claim 1, wherein the abrasive material has an average particle size between about 1 and about 50 micrometers.

13. The flexible sanding composite of claim 1, further comprising less than 1% by weight color pigment.

14. A flexible sanding composite in clay form comprising:
about 1% to about 20% by weight polybutene;
about 1% to about 20% by weight oleic acid;
about 30% to about 80% by weight abrasive material including calcium carbonate and aluminum oxide; and
up to about 5% by weight synthetic rubber.

15. The flexible sanding composite of claim 14, wherein the abrasive material has an average particle size between about 1 and about 50 micrometers.

16. The flexible sanding composite of claim 14, further comprising less than 1% by weight color pigment.

17. A method of removing dirt or contamination from a surface, or flattening surface irregularities, comprising:
rubbing a flexible sanding composite against the surface repeatedly until the dirt or contamination is diminished, or until the surface irregularities are flattened, wherein the flexible sanding composite includes:
about 1% to about 20% by weight polybutene;
about 1% to about 20% by weight oleic acid;
about 30% to about 80% by weight abrasive material including calcium carbonate and aluminum oxide; and
up to about 5% by weight synthetic rubber.

18. The method of claim 17, further comprising scratching the surface with the flexible sanding composite.

19. The method of claim 17, further comprising applying a lubricant to the surface prior to rubbing the surface with the flexible sanding composite.

20. The method of claim 17, wherein the surface is part of a vehicle.

21. The method of claim 17, wherein the surface is part of industrial machinery.

* * * * *